United States Patent [19]

Capp et al.

[11] Patent Number: 4,921,447

[45] Date of Patent: May 1, 1990

[54] TERMINATING A SHIELD OF A MALLEABLE COAXIAL CABLE

[75] Inventors: Randolph E. Capp, Mechanicsburg; William D. Couper, Harrisburg, both of Pa.

[73] Assignee: AMP Incorporated, Harrisburg, Pa.

[21] Appl. No.: 353,290

[22] Filed: May 17, 1989

[51] Int. Cl.[5] ..... H01R 13/00
[52] U.S. Cl. ..... 439/585
[58] Field of Search ..... 439/578–585, 439/874–876

[56] References Cited

U.S. PATENT DOCUMENTS 4,408,821 10/1983 Forney, Jr. .
4,452,503 6/1984 Forney, Jr. .
4,540,231 9/1985 Forney, Jr. .
4,712,296 12/1987 Forney, Jr. et al. .

OTHER PUBLICATIONS

Belden Comformable Coax Cables, Belden Wire & Cable, Richmond, Indiana, copyright 1987.

*Primary Examiner*—Joseph H. McGlynn

[57] ABSTRACT

A method of terminating a malleable external shield (16) of a malleable coaxial cable (2) is carried out by inserting an end of the cable (2) into a tubular connector body (5) through one end (41) thereof and driving a shield gripping tubular metal member (8) surrounding the cable (2) into the connector body (5) from the one end (41) thereof so that the shield gripping member (8) tightly grips the cable shield (16), an external peripheral end flange (38) on the shield gripping member (8) being proximate to the one end (41) of the connector body (5). In order to afford strain relief for the electrical connection between the shield gripping member (8) and the cable shield (16), a solder ring (48) surrounding the cable (2) is held on the flange (38) and an induction heating ring (50) is employed to melt the solder ring (48) to provide a solder fillet (52) rigidly connecting the flange (38) to the cable shield (16).

17 Claims, 2 Drawing Sheets

TERMINATING A SHIELD OF A MALLEABLE COAXIAL CABLE

FIELD OF THE INVENTION

This invention relates to a method of terminating a malleable external shield of a malleable coaxial cable by means of a tubular connector body and a shield gripping tubular metal member having an external peripheral flange surrounding one end thereof. The invention also relates to an electrical connector body terminating such a shield.

BACKGROUND OF THE INVENTION

There is disclosed in U.S. Pat. No. 4,452,503, a method of terminating a solid metal shield of a semi-rigid coaxial cable which method comprises the steps of; inserting an end of the cable into a tubular connector body through one end thereof; driving a shield gripping tubular metal member in the form of a shield gripping ring, in surrounding relationship with the cable, into the connector body from said one end thereof, into force fitting relationship with the connector body, tightly to grip the cable shield, and thereby positioning a flange on the trailing end of the shield gripping ring proximate to said one end of the connector body and externally thereof. The shield gripping ring has projecting therefrom spline fingers which are forced into the shield of the cable as the shield gripping ring is driven into the connector body, so that effective electrical connection is made between the ring and the shield. Since the solid, relatively rigid, metal shield of such a cable tends to buckle when it is bent, the cable is unsuitable for use in a crowded environment, where it needs to be routed amongst other cables which have been terminated and are grouped together at an input-output panel, for example.

The rigid cable is bent to a desired orientation before assembling the cable to a connector. This avoids having to waste a connector if the cable is damaged by improper bending. A disadvantage is that the connector must be spaced a short distance from a bend in the cable, because the bend is a barrier to an assembly tool used to tighten the connector on the cable. A connector might be designed with loose component parts which will required a fixture to hold the parts stationary while solder is applied to join the parts to the cable. The bend in the cable is a barrier to the fixture. It would be desirable to have a cable that can be bent closely to an applied connector without risk of damage.

There is described in a new product bulletin referenced NP42-1, by Belden Wire and Cable, Richmond, Ind., (Copyright 1987 Cooper Industries Incorporated) a malleable coaxial cable called "conformable" coaxial cable, having a malleable external shield comprising a metal wire braid filled with a malleable metal, for example tin, by dipping the braid in the metal when in a molten state. Such cable, whilst retaining the electrical performance of the solid metal shielded cable mentioned above, has the advantage that it can readily be bent without buckling. When terminated, however, by the method described in U.S. Pat. No. 4,452,503, the electrical connection between the shield and the gripping of the cable shield.

Methods similar to those described in U.S. Pat. No. 4,452,503, are also described in U.S. Pat. Nos. 4,408,821, and 4,540,231. There is described in U.S. Pat. No. 4,712,296, method of using an electrical induction heating ring in the form of conductive metal plate, to fuse together parts of a coaxial electrical connector.

SUMMARY OF THE INVENTION

The present invention is intended to provide a method of terminating a malleable external shield of a malleable coaxial cable, whereby the cable can be flexed without impairing the integrity of the electrical connection between the shield gripping tubular metal member and the cable shield.

According to the method of the invention, after the shield gripping metal member has been driven into the connector body from said one end thereof, a solder ring is held against the flange on the opposite side thereof to the connector body and in surrounding relationship with the cable, and the solder ring and the flange, as well as the cable in the vicinity of the flange are heated, thereby melting the soldering ring to produce a solder fillet rigidly connecting the flange to the shield of the cable, so as to provide strain relief for said electrical connection, whereby the cable may be flexed without weakening that connection.

Conveniently, the soldering ring is held against the flange by force of gravity, this being done by positioning the connector body so that it extends vertically with the flange uppermost, following the step of driving the shield gripping member into the connector body; and then placing the soldering ring on the flange, for the heating step.

The heating step may be carried out by holding the flange and the soldering within an electrical induction heating ring and energizing the heating ring in order to carry out the heating step. By use of the induction heating ring, the heat is focused upon the areas to be heated so that undue expansion of the dielectric material of the malleable cable is thereby avoided.

The flange, which is preferably spaced from said one end of the connector body, is preferably tin plated for solder wetting, the solder ring being of a commercially available kind which is self fluxing. The shield gripping member is preferably of substantially smaller mass than the connector body and is made of an inherently temperature responsive material, for example, brass, the connector body being made of a less temperature responsive material, for example, stainless steel and being of substantially greater mass than the shield gripping member. Under such conditions, the flange will quickly rise in temperature when the heating ring is energized, undue withdrawal of heat by the connector body being avoided.

According to another aspect of the invention a coaxial electrical connector comprises in combination, a malleable coaxial cable having a malleable external shield; a tubular connector body; and a shield gripping tubular metal member having an external peripheral flange surrounding one end thereof. The cable extends through the connector body and the shield gripping member, which is interposed between the cable and the connector body in force fitting relationship therewith with the flange proximate to one end of the connector body and being located externally thereof. The connector further comprises a solder fillet extending about the cable and rigidly connecting the flange to the cable on the opposite side of the flange to the connector body.

The flange is preferably spaced from the one end of the connector body to avoid the latter bleeding heat from the flange when the solder fillet is being formed.

DETAILED DESCRIPTION OF THE INVENTION

Figures 1, 2, 3, 4:
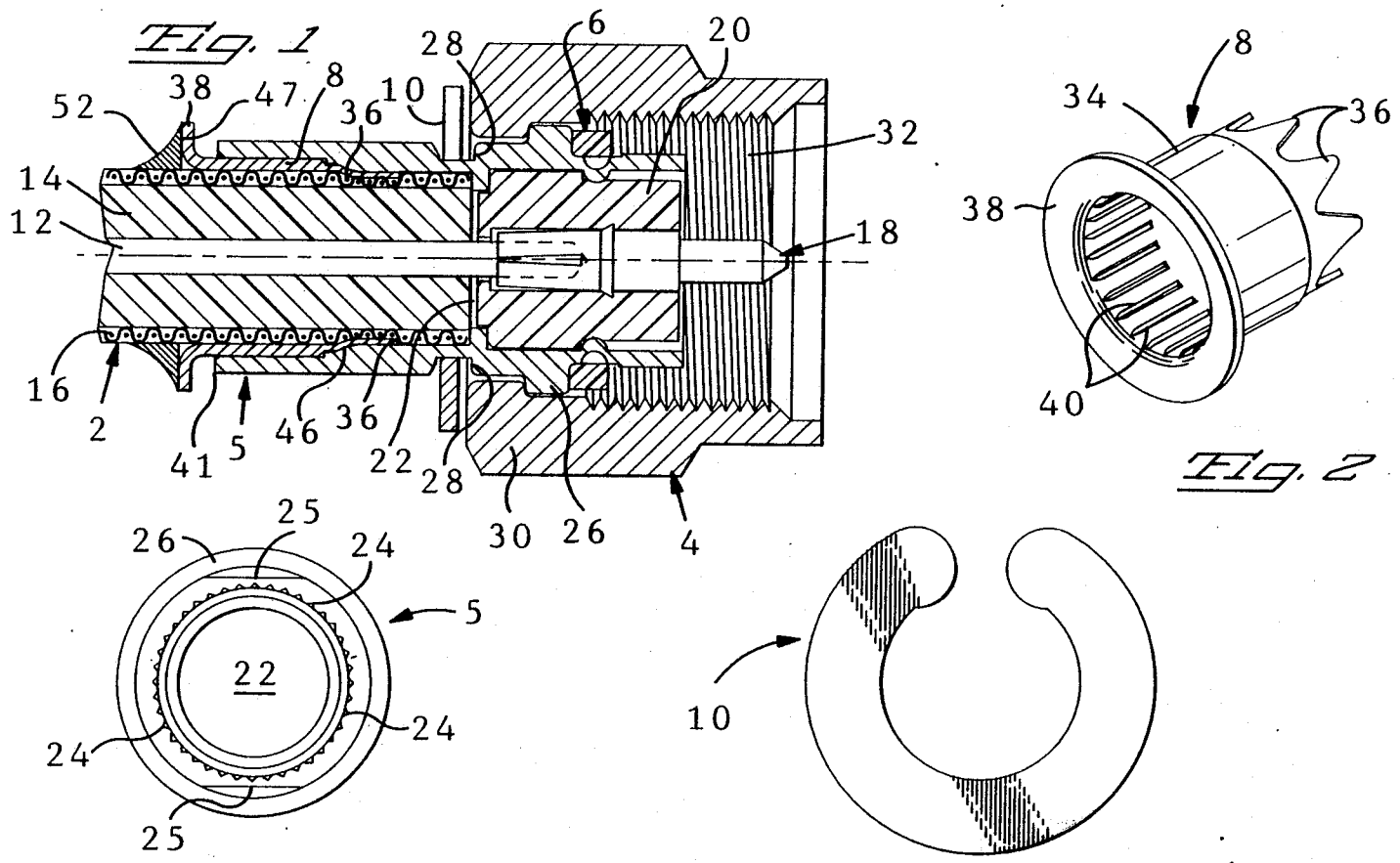
FIG. 1 is an axial sectional view illustrating an electrical connector which has been terminated to malleable coaxial cable.
FIG. 2 is an isometric view of a shield gripping tubular metal member of the connector, in the form of the shield gripping ring.
FIG. 3 is an enlarged rear end view of a tubular shell connector body of the connector.
FIG. 4 is an elevational view of C-clip of the connector.

An electrical connector for terminating a malleable coaxial cable 2 comprises an elongate coupling nut 4, a tubular shell connector body 5, an elastomeric gasket ring 6, a shield gripping tubular metal member in the form of a shield gripping ring 8 and a nut captivating C-clip 10, as shown in FIGS. 1 to 4. The cable 2 comprises a center conductor 12, surrounded by a dielectric layer 14, which is in turn surrounded by malleable, external shield 16 comprising a metal braid filled with a malleable metal, for example tin, by dipping it into that metal when in a molten state. Such a cable is described in the Belden New Product Bulletin mentioned above which is incorporated herein by reference. The dielectric layer 14 and the shield 16 were stripped back to expose the end portion of the center conductor 12 to which portion was inserted into a gripping socket end of an electrical pin terminal 18 which has been earlier force fitted into a through bore in a dielectric plug 20 secured in the forward end part of the connector body 5. The pin terminal 18 projects forwardly from the plug 20 into the nut 4. The body 5 has a through bore 22, accommodating an end portion of the cable 2, the terminal 18 and the plug 20. The rearward portion of the wall of the bore 22 is formed with a ring of axial grooves 24 extending about its internal periphery. The rear end portion of the body 5 is formed with a pair of opposed external lands 25 as shown in FIG. 3. Towards its forward end, the connector body 5 has an external peripheral nut captivating flange 26 against the forward face of which the gasket ring 6 rests. Rearwardly of the flange 26, the connector body 2 has an external peripheral groove 28 for receiving the C-clip 10. The nut 4 has an inwardly projecting annular rear lip 30 and forwardly thereof an internal screw thread 32 for meshing with an external screw thread of a mating socket coaxial connector (not shown).

The shield gripping ring 8 has a rigid annular body portion 34, a ring of spline fingers 36 projecting forwardly from the periphery of the body portion 34 and an external peripheral flange 38 at the rear end of the portion 34. The internal wall of the portion 34 is formed with a ring of axially extending grooves 40.

Figure 5:
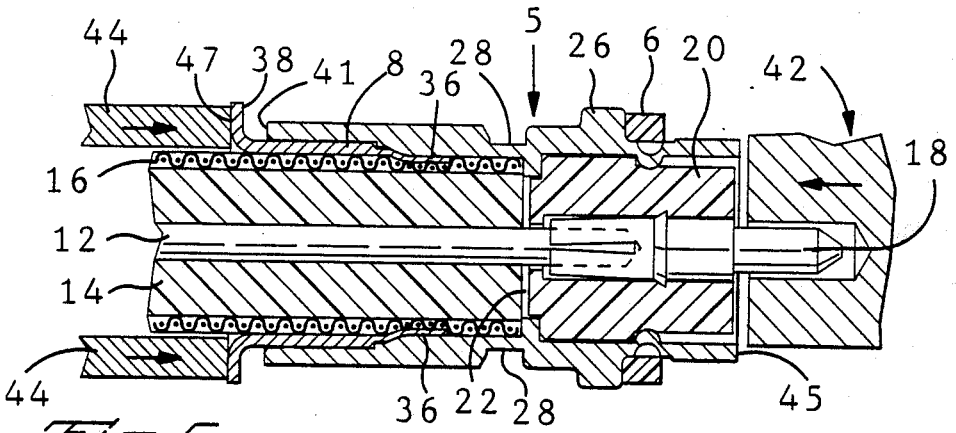
FIGS. 5 to 7 are axial sectional views illustrating consecutive steps in a method of terminating the malleable cable by means of the connector.
Figure 6:
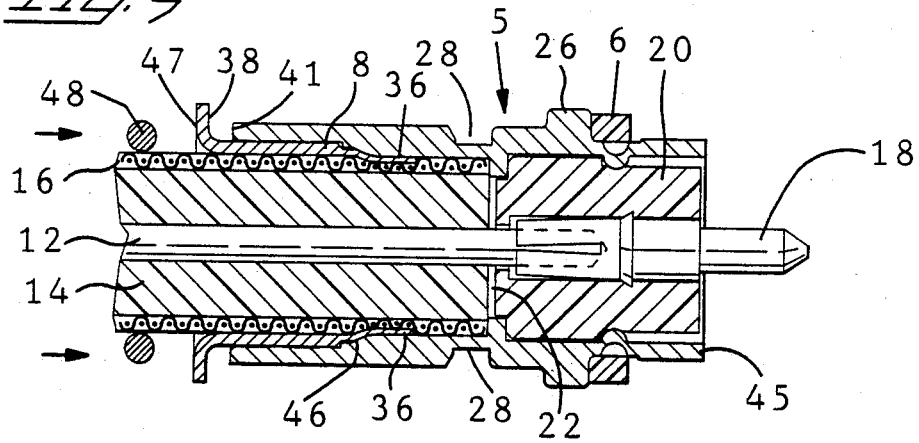
Figure 7:
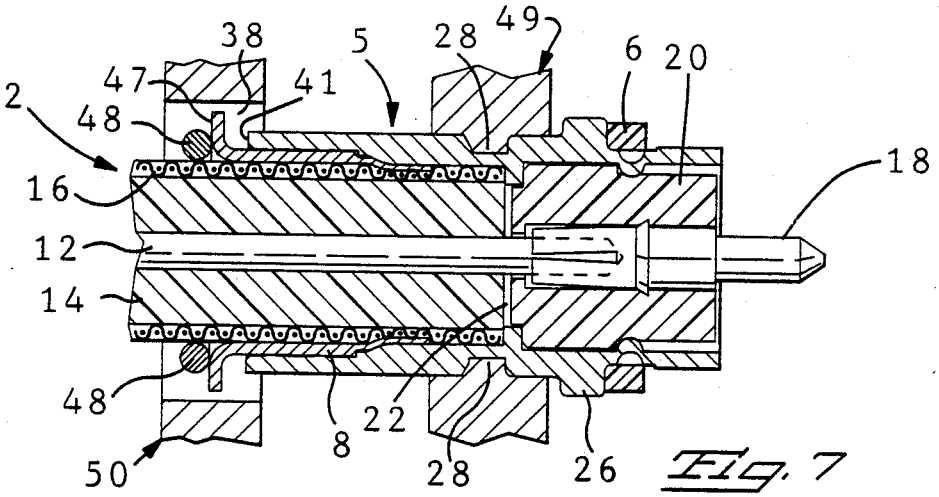

In order to terminate the connector to the cable 2, the stripped end of the cable 14 is inserted into the bore 22 through the rear end 41 of the connector body 5, inserting conductor end 12 into pin 18. The shield gripping ring 8 is pre-assembled to body 5 prior to cable insertion. The shield gripping ring 8 is then partially inserted, in surrounding relationship with the cable 2, into the body 5 from its rear end 41 with the spline fingers 36 leading. As shown in FIG. 5, assembly tool clamping members 42 and 44 are then moved towards one another along a common axis so as to be applied to the forward end 45 of the connector body 5 and to the rear face 47 of the flange 38, respectively, thereby to drive the shield gripping ring 8 home into the bore 22 of the body 5 into force fitting relationship with the body 5, tightly to grip the shield 16 of the cable 2 and thereby to position the flange 38 proximate to said rear end 41 of the body 5, and externally thereof. As the spline fingers 36 of the gripping ring 8 are forced into the bore 22, they are deflected radially inwardly by an internal contour 46 thereof so that the fingers 36 are forced into the malleable cable shield 16, ploughing progressively deeper furrows therein as they advance. The interaction between the surface of the rigid body portion 34 of the ring 8, and the longitudinal grooves 24 the connector body 5, and the interaction between the grooves 40 in the portion 34 and the cable sheath 16 bring about an interlocking relationship between the connector body 5 and the cable 2. Externally originating torque generated on the cable 2 is thereby resisted. This technique is described in U.S. Pat. No. 4,408,421 which is incorporated herein by reference. The tool members 42 and 44 are now withdrawn and a commercially available solder ring 48, which is self fluxing, is advanced along the cable 2, in surrounding relationship therewith, towards the flange 38 as indicated by the arrows in FIG. 6. The structure as so far assembled, is then raised to a vertical position as shown in FIG. 7 with the flange 38 uppermost, so that the solder ring 48 is held against the face 47 of the flange 38 that is to say the side thereof opposite to the connector body 5, proximate to the cable shield 16. The assembled structure is manipulated by means of a clamp 49 to hold the flange 38 and the solder ring 48 within an electric induction heating ring 50 which may be in accordance with U.S. Pat. No. 4,712,296 which is incorporated herein by reference. The heating ring 50 which is in the form of a conductive metal plate is then energized to melt the solder ring 48 to produce a solder fillet 52 which as shown in FIG. 1 rigidly connects the rear face 47 of the flange 38 to the malleable cable shield 16. When the heating ring 50 is energized, the temperature of the flange 38 rises rapidly because the mass of the ring 8 is small relative to that of the connector body 5, the solder joint between the flange 48 and the shield 16 is improved if the ring 8, and in particular its flange 38 are tin plated for the promotion of solder wetting. In order to avoid heat being bled to an undue extent from the flange 38 by the connector body 5, the ring 8 is preferably made from an inherently temperature responsive material, for example, brass, the body 5 being made of less temperature responsive material, for example, stainless steel, and the flange 38 being spaced slightly from the rear end 41 of the body 5 as shown. By virtue of the provision of the solder fillet 52 flexure of the cable 2 will not effect the integrity of the electrical connection between the cable shield 16 and the ring 8, although the shield 16 was scored by the spline fingers 36 as the ring 8 was driven into the body 5 by the members 42 and 44.

The assembly having been removed from the heating ring 50 and released from the clamp 49, the nut 4 is moved along the cable 2 in surrounding relationship therewith, over the flange 38 and along the connector body 5 until annular lip 30 of the nut 4 abuts the flange 26 of the body 5, the c-clip 10 resiliently engaged in the external peripheral groove 28 of the body 5 whereby the nut 40 is captivated between the clip 10 and the flange 26, but is rotatable about the axis of the body 5. The thread 32 of the nut 4 may then be meshed with the external screw thread of said mating connector, the body 5 being held against rotation by means of a tool (not shown) applied to the lands 25.

What has been described is a preassembled connector in which the component parts hold themselves stationary without a fixture until final assembly onto a cable. The connector is assembled with solder to a cable construction that is malleable and thereby unsuitable for a pressure crimp connection. The connector is assembled further with a crimp connection to eliminate the drawbacks associated with loose parts requiring a fixture to hold the loose parts stationary during solder assembly to the cable.

What is claimed is:

1. A method of terminating a malleable external shield of a malleable coaxial cable, by means of a tubular connector body and a shield gripping tubular metal member having an external peripheral flange surrounding one end thereof, the method comprising the steps of;

inserting an end of said cable into said connector body through one end thereof;

driving said shield gripping member, in surrounding relationship with said cable, into said connector body from said one end thereof, into force fitting relationship with said connector body, tightly to grip said shield and thereby positioning said flange proximate to said one end of said connector body and externally thereof;

holding a solder ring against said flange on the opposite side thereof to said connector body and in surrounding relationship with said cable; and heating the solder ring and said flange, and said cable in the vicinity of said flange, and thereby melting the solder ring to produce a solder fillet rigidly connecting said flange to said shield.

2. A method as claimed in claim 1, comprising the step of positioning said connector body to extend vertically, with said flange uppermost, following said step of driving said shield gripping member into said connector body; and placing the solder ring on said flange prior to said solder ring heating step whereby the solder ring is held against the flange by force of gravity during said heating step.

3. A method as claimed in claim 1, wherein the solder ring is heated by holding the flange and the solder ring within an electric induction heating ring and energizing the heating ring.

4. A method as claimed in claim 2, wherein the flange, with the solder ring thereon, is introduced into an electric induction heating ring and the heating ring is energized to melt the solder ring to produce said fillet.

5. A method as claimed in claim 1, wherein said connector body is of substantially greater mass than said shield gripping member and is made of a less thermally responsive material.

6. A method as claimed in claim 5, wherein said connector body is made of stainless steel and said shield gripping member is made of a brass alloy.

7. A method as claimed in claim 1, wherein said flange is tin plated and said solder ring is self fluxing.

8. A method as claimed in claim 1, wherein during said step of driving said shield gripping member into said connector body, spline fingers projecting from said shield gripping member are forced into said shield and plough furrows therein.

9. A method as claimed in claim 1, wherein said shield comprises a wire braid filled with malleable metal.

10. A method as claimed in claim 1, wherein said shield gripping member is driven into said connector body into a home position in which said flange is spaced slightly from said one end of said connector body.

11. A coaxial electrical connector comprising in combination, a malleable coaxial cable having a malleable external shield; a tubular connector body; and a shield gripping tubular member having a peripheral flange surrounding one end thereof, said cable extending through said connector body and said shield gripping member, said shield gripping member being interposed between said cable and said connector body in force fitting relationship therewith with said flange proximate to one end of said connector body and positioned externally thereof, said connector further comprising a solder fillet extending about said cable and rigidly connecting said flange to said external shield on the opposite side of said flange to said connector body.

12. A connector as claimed in claim 11, wherein said flange is spaced from said one end of said connector body.

13. A connector as claimed in claim 11, wherein said shield comprises a wire braid filled with tin.

14. A connector as claimed in claim 11, wherein said connector body is of substantially greater mass than said shield gripping member, said shield gripping member being made of a brass alloy and said connector body being made of stainless steel.

15. A connector as claimed in claim 11, wherein said shield gripping member has spline fingers projecting therefrom and being embedded in said shield.

16. A connector as claimed in claim 11, wherein said connector body comprises an external annular flange proximated to the other end of said connector body, an external peripheral groove between said one end of the connector body and said annular flange, and a resilient clip received in said groove, a coupling nut mounted for rotation about said connector body being captive between said annular flange and said resilient clip, and being dimensioned so that it can be passed over said peripheral flange of said shield gripping member.

17. A method of terminating a malleable external shield of a malleable coaxial cable, by means of a tubular connector body and a shield gripping tubular metal member of substantially smaller mass than said body and having an external peripheral flange surrounding one end thereof, the method comprising the steps of;

inserting an end of said cable into said connector body through one end thereof;

electrically connecting said shield gripping member to said shield by driving said shield gripping member, in surrounding relationship with said cable, into said connector body from said one end thereof, into force fitting relationship with said connector body, tightly to grip said shield, and thereby positioning said flange proximate to said one end of the connector body and externally thereof; and producing a solder fillet surrounding said cable and rigidly connecting said flange to said shield, to provide strain relief for the electrical connection between said shield gripping member and said shield.

* * * * *